US010068741B2

(12) United States Patent
Takahashi et al.

(10) Patent No.: US 10,068,741 B2
(45) Date of Patent: Sep. 4, 2018

(54) FIELD EMISSION DEVICE AND REFORMING TREATMENT METHOD

(71) Applicant: MEIDENSHA CORPORATION, Tokyo (JP)

(72) Inventors: Daizo Takahashi, Numazu (JP); Toshimasa Fukai, Shizuoka (JP); Toru Tanimizu, Hitachi (JP)

(73) Assignee: MEIDENSHA CORPORATION, Tokyo (JP)

( * ) Notice: Subject to any disclaimer, the term of this patent is extended or adjusted under 35 U.S.C. 154(b) by 0 days.

(21) Appl. No.: 15/535,722

(22) PCT Filed: Dec. 22, 2015

(86) PCT No.: PCT/JP2015/085786
§ 371 (c)(1),
(2) Date: Jun. 14, 2017

(87) PCT Pub. No.: WO2016/104484
PCT Pub. Date: Jun. 30, 2016

(65) Prior Publication Data

US 2017/0365439 A1 Dec. 21, 2017

(30) Foreign Application Priority Data

Dec. 25, 2014 (JP) ..... 2014-262766

(51) Int. Cl.
*H01J 35/04* (2006.01)
*H01J 35/06* (2006.01)
(Continued)

(52) U.S. Cl.
CPC ..... *H01J 35/065* (2013.01); *H01J 1/304* (2013.01); *H01J 35/12* (2013.01); *H01J 35/16* (2013.01)

(58) Field of Classification Search
CPC ..... H01J 35/16; H01J 2235/081; H01J 2235/086; H01J 2235/087;
(Continued)

(56) References Cited

U.S. PATENT DOCUMENTS 4,679,219 A 7/1987 Ozaki
4,912,739 A * 3/1990 Weiss ..... H01J 35/14 378/125
(Continued)

FOREIGN PATENT DOCUMENTS

JP 61-62344 U 4/1986
JP 2005-346942 A 12/2005
(Continued)

OTHER PUBLICATIONS

Korean Office Action, dated Aug. 7, 2017, 3 pages.
(Continued)

*Primary Examiner* — Irakli Kiknadze
(74) *Attorney, Agent, or Firm* — Foley & Lardner LLP

(57) ABSTRACT

In a vacuum chamber (1), an emitter (3) and a target (7) are opposed to each other. A guard electrode (5) is disposed around an outer circumference of an electron generating portion (31) of the emitter (3). A supporting part (4) supports the emitter (3) movably in an end-to-end direction of the vacuum chamber (1). Reforming treatment is performed on the guard electrode (5) by operating the supporting part (4), moving the emitter (3) to an open end (21) side (non-discharge position) and applying a voltage to repeatedly effect discharge on the guard electrode (5) in a state where field emission from the electron generation portion (31) is suppressed. After the reforming treatment, the supporting part (4) is again operated. The emitter (3) is moved to an
(Continued)

open end (22) side (discharge position) and placed in a state where field emission from the electron generation portion (31) is allowed.

24 Claims, 4 Drawing Sheets

(51) Int. Cl.
*H01J 35/12* (2006.01)
*H01J 35/16* (2006.01)
*H01J 1/304* (2006.01)

(58) Field of Classification Search
CPC ..... H01J 2235/186; H01J 35/08; H01J 35/10; H01J 35/14; H01J 35/24; H01J 35/28; H01J 35/06; H01J 35/12; H01J 35/18; H01J 5/18; H01J 2235/18; H01J 2235/183; H01J 2235/1216; H01J 1/16; H01J 2235/068; H01J 2235/166; H01J 2235/06; H01J 2237/06358; H01J 35/30; H01J 35/045; H01J 35/065; H01J 35/26; H01J 35/305; H01J 3/021; A61B 6/035; A61B 6/4028
USPC ..... 378/119, 121, 135
See application file for complete search history.

(56) References Cited

U.S. PATENT DOCUMENTS

| | | | | |
|---|---|---|---|---|
| 8,761,344 | B2 * | 6/2014 | Reynolds | H01J 35/06 378/136 |
| 2007/0046166 | A1 | 3/2007 | Okada et al. | |
| 2011/0115363 | A1 | 5/2011 | Ishiguro et al. | |
| 2011/0142193 | A1 * | 6/2011 | Frontera | H01J 35/045 378/16 |
| 2012/0027177 | A1 | 2/2012 | Ogata et al. | |

FOREIGN PATENT DOCUMENTS

| | | | |
|---|---|---|---|
| JP | 2008-166059 | A | 7/2008 |
| JP | 2010-56062 | A | 3/2010 |
| JP | 2010-186694 | A | 8/2010 |
| JP | 2011-119084 | A | 6/2011 |
| JP | 2012-049122 | A | 3/2012 |

OTHER PUBLICATIONS

Japanese Office Action and English translation, dated Dec. 20, 2016, 7 pages.
Written Argument to Japanese Office Action and English translation, dated Feb. 17, 2017, 5 pages.
Amendment and English translation, Feb. 17, 2017, 7 pages.
Notice of Allowance and English translation, dated Mar. 28, 2017, 4 pages.

* cited by examiner

FIELD EMISSION DEVICE AND REFORMING TREATMENT METHOD

FIELD OF THE INVENTION

The present invention relates to a field emission device applicable to various types of equipment such as X-ray apparatus, electron tube, lighting apparatus etc., and to a reforming treatment method therefor.

BACKGROUND ART

There is known a field emission device applicable to various types of equipment such as X-ray apparatus, electron tube, lighting apparatus etc., in which an emitter (an electron source made of a carbon material or the like) and a target are opposed to each other (with a predetermined distance left therebetween) in a vacuum chamber of a vacuum vessel such that field emission from the emitter is caused (electrons are generated and emitted) with the application of a voltage between the emitter and the target so as to thereby emit an electron beam onto the target and perform a desired function (e.g. a radioscopic resolution function due to external X-ray radiation in the case of X-ray apparatus).

Further, techniques have been studied to suppress scattering of the electron beam from the emitter by adopting a triode structure where a grid electrode is interposed between the emitter and the target, by forming a curved surface on an electron generating portion of the emitter (which is located opposite the target and from which electrons are generated), or by arranging a guard electrode of the same potential as the emitter on a circumferential edge side of the emitter (see Patent Documents 1 and 2).

It is preferable to emit the electron beam by generating electrons only from the electron generating portion of the emitter with the application of the voltage as mentioned above. In the presence of an unnecessary minute projection or dirt in the vacuum chamber, however, it becomes likely that a flashover phenomenon will occur. The field emission device may thus not attain a desired withstand voltage.

The above problem arises in the case where the guard electrode or the other component inside the vacuum chamber (more specifically, the target, the grid electrode, the guard electrode or the like; hereinafter simply referred to as the "guard electrode etc." as required) has a part that can easily cause local field concentration (e.g. a minute projection is formed on the guard electrode etc. by processing work), in the case where a gas component is adsorbed on the guard electrode etc. and in the case where the guard electrode etc. contains an element that can easily generate electrons. In these cases, the amount of electrons generated in the field emission device becomes unstable due to the formation of an electron generating portion on the guard electrode etc. As a result, it becomes likely that the electron beam will be scattered. This leads to the problem of, in the case of X-ray apparatus, X-ray defocusing.

It has accordingly been studied, as a technique for suppressing the flashover phenomenon (i.e. a technique for stabilizing the electron generation amount), to perform voltage discharge conditioning treatment (reforming (regeneration); hereinafter referred to as "reforming treatment") of applying a voltage (high voltage etc.) to the guard electrode etc. (e.g. the guard electrode and the grid electrode) and repeatedly effecting discharge on the guard electrode etc.

PRIOR ART DOCUMENTS

Patent Documents

Patent Document 1: Japanese Laid-Open Patent Publication No. 2011-119084

Patent Document 2: Japanese Laid-Open Patent Publication No. 2010-56062

SUMMARY OF THE INVENTION

When the reforming treatment voltage is simply applied to the guard electrode etc. as mentioned above, however, there is likely to occur field emission from the emitter (e.g. before the execution of the reforming treatment) so that the guard electrode etc. may not be sufficiently reformed by the reforming treatment.

The present invention has been made in view of the foregoing problems. It is an object of the present invention to provide a field emission device and reforming treatment method for performing reforming treatment on a guard electrode etc., while suppressing field emission from an emitter, and thereby attaining a desired withstand voltage.

As a solution to the above problems, there is provided according to one aspect of the present invention a field emission device, comprising: a vacuum vessel with a cylindrical insulator, the insulator having both ends sealed to define a vacuum chamber on an inner wall side of the insulator; an emitter located on one end side of the vacuum chamber and having an electron generating portion facing the other end side of the vacuum chamber; a guard electrode disposed on an outer circumferential side of the electron generating portion of the emitter; a target located on the other end side of the vacuum chamber and opposed to the electron generating portion of the emitter; and a supporting part that supports the emitter movably in an end-to-end direction of the vacuum chamber, the supporting part being movable so as to change a distance between the electron generating portion of the emitter and the target by movement of the supporting part.

There is provided according to another aspect of the present invention a field emission device, comprising: a vacuum vessel with a cylindrical insulator, the insulator having both ends sealed to define a vacuum chamber on an inner wall side of the insulator; an emitter located on one end side of the vacuum chamber and having an electron generating portion facing the other end side of the vacuum chamber; a target located on the other end side of the vacuum chamber and opposed to the electron generating portion of the emitter; a supporting body that has a shape extending from a side of the emitter opposite the electron generating portion and supports the emitter; a guard electrode disposed on an outer circumferential side of the electron generating portion of the emitter, the guard electrode having a cylindrical shape extending in an end-to-end direction of the vacuum chamber and being supported at one end side thereof on the vacuum vessel; and a bellows supported at one end side thereof on the supporting body and supported at the other end side thereof on the vacuum vessel so as to constitute a part of the vacuum vessel.

There is provided according to still another aspect of the present invention a field emission device, comprising: a vacuum vessel with a cylindrical insulator, the insulator having both ends sealed to define a vacuum chamber on an inner wall side of the insulator; an emitter located on one end side of the vacuum chamber and having an electron generating portion facing the other end side of the vacuum chamber; a target located on the other end side of the vacuum chamber and opposed to the electron generating portion of the emitter; a guard electrode disposed on an outer circumferential side of the electron generating portion of the emitter, the guard electrode having a cylindrical shape extending in an end-to-end direction of the vacuum chamber and being supported at one end side thereof on the vacuum vessel; and a supporting part, wherein the supporting part includes: a supporting body that has a shape extending from a side of the emitter opposite the electron generating portion and supports the emitter; a magnetic body disposed on an extending direction side of the supporting body; a circumferential wall that has a shape extending outwardly from a portion of the vacuum vessel opposed to the extending direction side of the supporting body and surrounds the supporting body and the magnetic body; and a magnet disposed on an outer wall surface of the circumferential wall; and wherein the relationship of $t1 \leq t \leq t2$ is satisfied where t1 is a distance from a movement range of the magnetic body to the outer wall surface of the circumferential wall at a position opposed to the movement range of the magnetic body; t2 is a maximum distance at which a magnetic attractive force can be generated between the magnet and the magnetic body by the action of a magnetic force of the magnet on the magnetic body; and t is a minimum distance between the magnet and the magnetic body.

The field emission device may be so structured that: the magnetic body has a diameter larger than that of the extending direction side of the supporting body; and the circumferential wall includes a narrowed region formed between the movement range of the magnetic body and the emitter and having a diameter smaller than that of the magnetic body. There may be a gap left between an inner wall surface of the narrowed region and the movement range of the magnetic body. The field emission device may be so structured that: the guard electrode has a cylindrical shape extending in the end-to-end direction of the vacuum chamber on the outer circumferential side of the emitter; and the electron generating portion of the emitter can be moved by the movement of the supporting part so as to be brought into contact with or separated apart from a target side of the guard electrode. The guard electrode may have a small-diameter region formed on the target side thereof. The guard electrode has an edge region formed on the target side thereof such that the edge region extends in a transverse direction of the vacuum chamber and overlaps a circumferential edge region of the electron generating portion of the emitter in the end-to-end direction of the vacuum chamber. Furthermore, the field emission device may have a grid electrode arranged between the emitter and the target within the vacuum chamber.

There is provided according to yet another aspect of the present invention a reforming treatment method for the above field emission device, comprising: in a state where the electron generating portion of the emitter and the guard electrode are separated apart from each other by operation of the supporting part, performing reforming treatment on at least the guard electrode within the vacuum chamber by the application of a voltage to the guard electrode.

As discussed above, it is possible according to the present invention to perform reforming treatment on the guard electrode etc., while suppressing field emission from the emitter, whereby the field emission device attains a desired withstand voltage.

DESCRIPTION OF THE EMBODIMENTS

Figure 1:
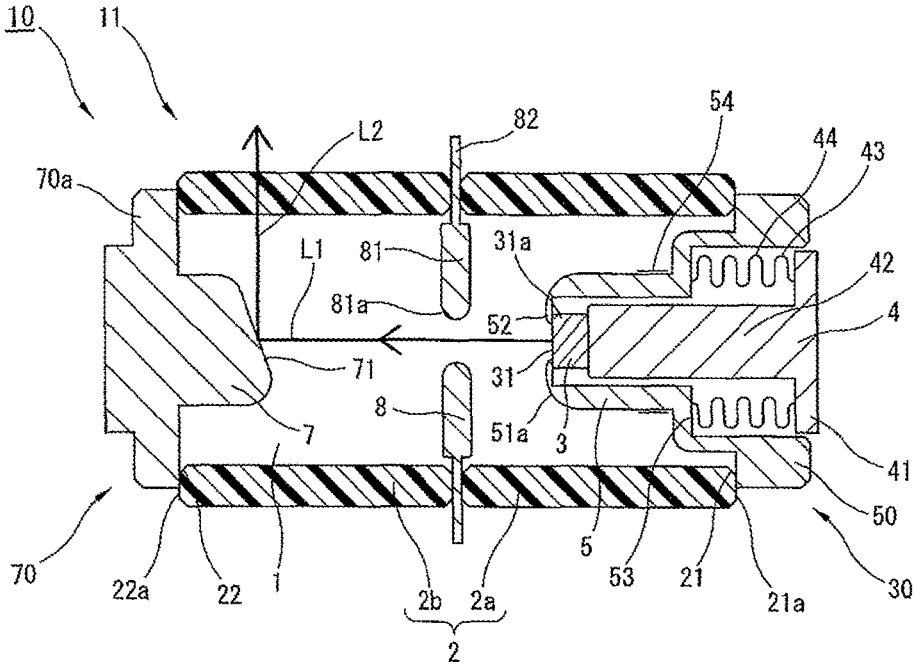
FIG. 1 is a schematic cross-sectional view of a field emission device according to Embodiment 1 of the present invention (taken along an end-to-end direction of a vacuum chamber 1 (in a state where an emitter 3 and a guard electrode 5 are in contact with each other)).

A field emission device according to the present aspect of the invention includes not only: an insulator having both ends sealed to define a vacuum chamber; an emitter and a target located opposite to each other in the vacuum chamber; and a guard electrode disposed around the outer circumference of an electron generating portion of the emitter, but also a supporting part arranged to support the emitter movably in a direction between opposite ends of the vacuum chamber (referred to as "end-to-end direction") and movable so as to change a distance between the electron generating portion of the emitter and the target by movement of the supporting part.

As a reforming treatment technique other than by simply applying a high voltage to the guard electrode etc. as mentioned above, it is conventionally known to perform reforming treatment by leaving the guard electrode etc. in a vacuum atmosphere and removing an adsorption gas from the guard electrode etc. This conventional method is carried out by, for example, connecting a large-diameter evacuation pipe to the vacuum vessel in the field emission device (referred to as "conventional device"); setting the vacuum chamber to a high-temperature vacuum atmosphere through the large-diameter evacuation pipe, thereby releasing an adsorption gas from the guard electrode etc. inside the vacuum chamber; returning the vacuum chamber to an air atmosphere; placing the emitter etc. in the vacuum chamber through the large-diameter evacuation pipe; sealing the vacuum chamber; and then setting the vacuum chamber again to a vacuum atmosphere.

In the vacuum vessel to which the large-diameter evacuation pipe is connected as mentioned above, however, it is difficult to maintain the high-temperature vacuum atmosphere of the vacuum chamber for a long time. Further, there is a possibility of re-adsorption of gas onto the guard electrode etc. during a period before setting the vacuum chamber again to the vacuum atmosphere. A rough surface of the guard electrode etc. cannot be reformed (smoothened) due to these reasons. In addition, the use of the large-diameter evacuation pipe leads to upsizing of the vacuum vessel and increases of manufacturing labor and cost.

In the present aspect, on the other hand, the reforming treatment is performed on the guard electrode etc. without the utilization of the above-mentioned conventional method. To perform the reforming treatment, the emitter is moved from a discharge position to a non-discharge position (at which the emitter becomes lower than or equal to a discharge field) (moved in a direction that increases the distance between the electron generating portion and the target) by operation of the supporting part. Then, the field emission device is placed in a state where field emission from the emitter is suppressed (e.g. the electron generating portion of the emitter and the guard electrode are separated apart from each other (with a space left therebetween) as shown in after-mentioned FIG. 2). In this state, the reforming treatment is performed on the guard electrode etc. with the application of a voltage so that a surface of the guard electrode etc. is melted and smoothened. Thus, the field emission device attains a desired withstand voltage. In the state where the field emission is suppressed as mentioned above, load is prevented from being exerted on the emitter during the reforming treatment.

After the reforming treatment is performed on the guard electrode etc., the emitter is moved from the non-discharge position to the discharge position (moved in a direction that decreases the distance between the electron generating portion and the target) by re-operation of the supporting part. The field emission device is then placed in a state where field emission from the emitter is allowed (e.g. the electron generating portion of the emitter and the guard electrode are in contact with each other as shown in after-mentioned FIG. 1). In this state, the field emission device is able to perform its desired function (e.g. in the case of X-ray apparatus, perform a X-ray radiation function).

In the present aspect, even when a minute projection is present on the surface of the guard electrode etc., the surface of the guard electrode etc. is melted and smoothened by the reforming treatment. When a gas component (e.g. a gas component remaining in the vacuum chamber) is adsorbed on the surface of the guard electrode etc., such adsorption gas is released from the surface of the guard electrode etc. by the reforming treatment. When the surface of the guard electrode etc. contain an element that can easily generate electrons, such an electron generating element is kept inside the guard electrode etc. by the above-mentioned melting and smoothening treatment so as to suppress generation of electrons from the electron generating element. It is therefore possible to easily stabilize the electron generation amount of the field emission device.

A variety of modifications can be made to the field emission device of the present aspect with reference technical knowledge of various fields as long as the field emission device is provided with the supporting part to support the emitter movably in the end-to-end direction and change the distance between the electron generating portion of the emitter and the target as mentioned above. By way of example, the field emission device of the present aspect can be embodied as follows.

≪ Field Emission Device According to Embodiment 1≫

Figure 2:
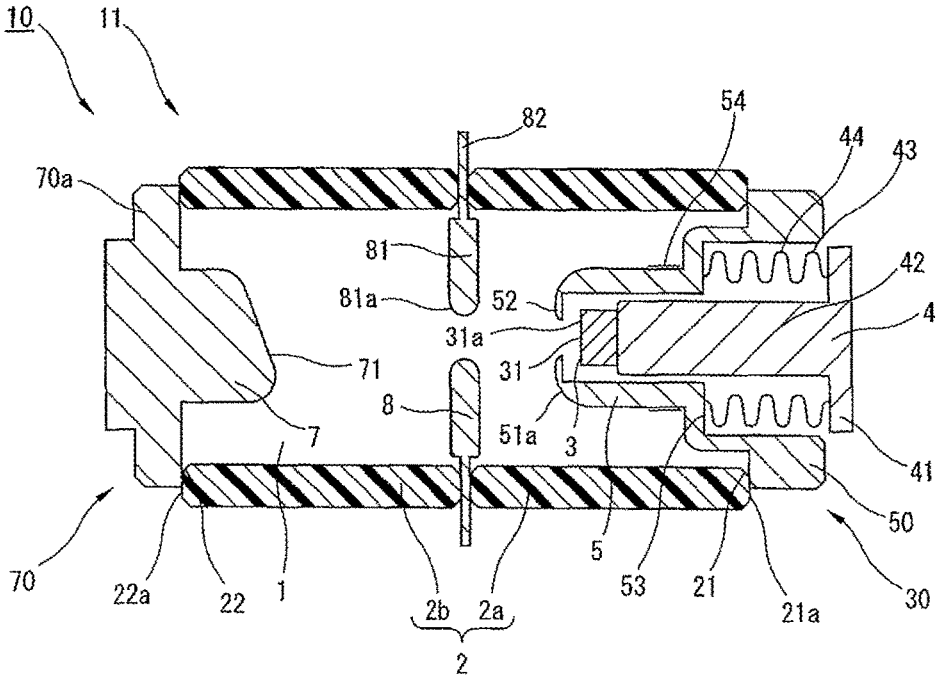
FIG. 2 is a schematic cross-sectional view of the field emission device according to Embodiment 1 of the present invention (taken along the end-to-end direction of the vacuum chamber 1 (in a state where the emitter 3 and the guard electrode 5 are separated apart from each other)).

In FIGS. 1 and 2, reference numeral 10 denotes an X-ray apparatus with the field emission device according to Embodiment 1 of the present aspect. In this X-ray apparatus 10, both open ends 21 and 22 of a cylindrical insulator 2 are sealed by (e.g. sealed by brazing) an emitter unit 30 and a target unit 70, respectively, to constitute a vacuum vessel 11 with a vacuum chamber 1 defined on an inner wall side of the insulator 2. A grid electrode 8 is arranged between the emitter unit 30 (after-mentioned emitter 3) and the target unit 70 (after-mentioned target 7) along a transverse direction of the vacuum chamber 1.

The insulator 2 is made of an insulating material such as ceramic material. As long as the insulator 2 defines therein the vacuum chamber 1 and provides insulation between the emitter unit 30 (after-mentioned emitter 3) and the target unit 70 (after-mentioned target 7), various forms are applicable to the insulator 2. In the illustrated embodiment, the insulator 2 has two cylindrical insulating members 2*a* and 2*b* coaxially arranged and assembled together by brazing, with the grid electrode 8 (after-mentioned lead terminal 82) interposed between the insulating members 2*a* and 2*b*.

The emitter unit 30 includes: an emitter 3 having an electron generating portion 31 opposed to and facing the target unit 70 (after-mentioned target 7); a supporting part 4 that is movable and supports the emitter 3 movably in the end-to-end direction; and a guard electrode 5 disposed on an outer circumferential side of the electron generating portion 31 of the emitter 3.

Various forms are applicable to the emitter 3 as long as the emitter 3 is provided with the electron generating portion 31 (as an electron emitter) to generate electrons from the electron generating portions 31 with the application of a voltage and thereby emit an electron beam L1 as illustrated in the figure. For example, the emitter 3 can be formed of a carbon material (e.g. carbon nanotubes) by molding into a bulk shape as illustrated in the figures or by deposition as a thin film. It is preferable that a surface of the electron generating portion 31 facing the target unit 70 (after-mentioned target 7) is concave (curved) in shape so as to facilitate focusing of the electron beam L1.

Various forms are applicable to the supporting part 4 as long as the supporting part 4 is adapted to support the emitter 3 movably in the end-to-end direction as mentioned above. In the illustrated embodiment, the supporting part 4 has a cylindrical column shape extending in the end-to-end direction on an inner side of the guard electrode 5, and includes: a flange portion 41 located on one end side (open end 21 side) thereof; a supporting body 42 located on the other end side (open end 22 side) thereof to support thereon the emitter 3 (by fixing e.g. swaging or fusing to a portion of the emitter 3 opposite the electron generating portion 31); and a bellows 43 expandable and contractible in the end-to-end direction and supported on the vacuum vessel 11 (e.g. supported in the insulator 2 via the guard electrode 5 as illustrated in the figures). When the supporting part 4 is provided with the supporting body 42 and the bellows 43, the supporting body 42 moves in the end-to-end direction according to expansion and contraction of the bellows 43 to cause movement of the emitter 3 in the end-to-end direction. As the material of the supporting part 4, various materials are usable without particular limitation. For example, the supporting part 4 can be made of a conductive metal material such as stainless steel (SUS) or copper.

Various forms are applicable to the bellows 43 as long as the bellows 43 is expandable and contractible in the end-to-end direction as mentioned above. It is feasible to form the bellows 43 by e.g. processing a thin metal plate material as appropriate. In the illustrated embodiment, the bellows 43 is formed with a bellows-like cylindrical wall 44 such that the bellows-like cylindrical wall 44 extends in the end-to-end direction and surrounds an outer circumference of the supporting body 42.

The bellows 43 is herein supported, by fixing e.g. brazing one end side of the bellows 43 to the flange portion 41 of the supporting body 42 and fixing e.g. brazing the other end side of the bellows 43 to the inner side (inner circumferential surface) of the guard electrode 5, so as to provide a partition between the vacuum chamber 1 and the atmosphere side (the outer circumferential side of the vacuum vessel 11) and keep the vacuum chamber 1 hermetically sealed. The bellows 43 is however not limited to the above form. The bellows 43 can be provided in various forms as long as the bellows 43 is supported at one end side thereof on the supporting part 4 (e.g. the flange portion 41 or the supporting body 42) and at the other end side thereof on the vacuum vessel 11 (e.g. the inner side of the guard electrode 5 or the after-mentioned flange portion 50), is expandable and contractible in the end-to-end direction, and is adapted to partition the vacuum chamber 1 from the atmosphere side (the outer circumferential side of the vacuum vessel 11) and keep the vacuum chamber 1 hermetically sealed (constitute a part of the vacuum vessel 11) as mentioned above.

The guard electrode 5 is disposed on the outer circumferential side of the electron generating portion 31 of the emitter 3 as mentioned above. Various forms are applicable to the guard electrode 5 as long as: the electron generating portion 31 of the emitter 3 is brought into or separated from the guard electrode 5 by movement of the supporting part 4 and; and the guard electrode 5 is adapted to, in a state where the emitter 3 is in contact with the guard electrode 5, suppress scatting of the electron beam L1 from the emitter 3.

The guard electrode 5 is made of e.g. stainless steel (SUS) and has a cylindrical shape extending in the end-to-end direction of the vacuum chamber 1 on the outer circumferential side of the emitter 3. A flange portion 50 is formed on one end side of the guard electrode 5 in the end-to-end direction such that one end side of the guard electrode 50 is supported on an end face 21*a* of the open end 21 of the insulator 2 via the flange portion 50, whereas the emitter 3 is brought into contact with or separated apart from the other end side (target 7 side) of the guard electrode 5 in the end-to-end direction.

Figure 3:
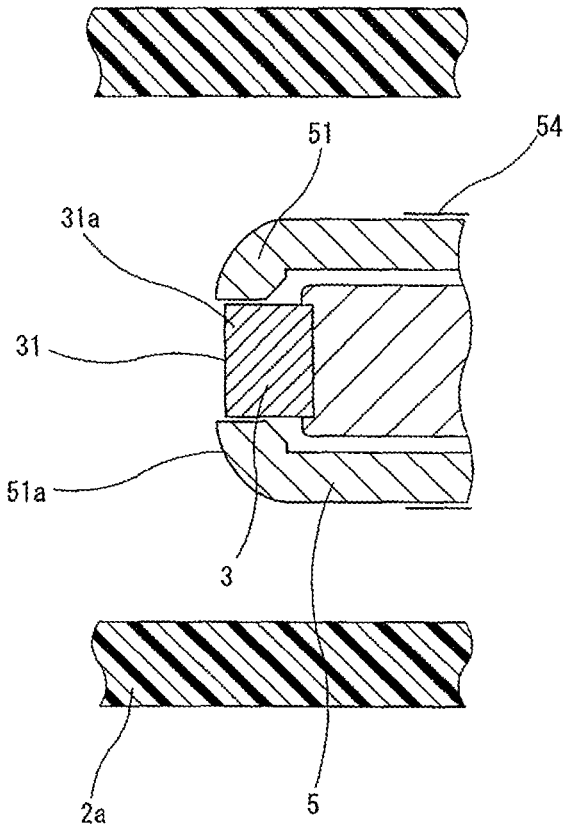
FIG. 3 is a schematic view of a modified example of the guard electrode 5 according to Embodiment 1 of the present invention (as corresponding to an enlarged view of part of FIG. 1 and showing the case where a small-diameter region 51 is formed instead of an edge region 52).

There is no particular limitation on the configuration of the guard electrode 5 for contact with or separation from the emitter 3. For example, a small-diameter region 51 may be formed on the other end side of the guard electrode 51 in the end-to-end direction as shown in FIG. 3. Alternatively, an edge region 52 may be formed on the other side of the guard electrode 51 in the end-to-end direction such that the edge region 52 extends in the transverse direction of the vacuum chamber 1 and overlaps a circumferential edge region 31*a* of the electron generating portion 31 of the emitter 3 as shown in FIGS. 1 and 2. It is feasible to form both of the small-diameter region 51 and the edge region 52 (see after-mentioned FIGS. 4 to 7).

When the guard electrode 5 is provided with such a contact/separation configuration, the electron generating portion 31 of the emitter 3 is brought into contact with or separated apart from the small-diameter region 51 or the edge region 52 of the guard electrode 5 as the emitter 3 is moved in the end-to-end direction on the inner side (cylindrical inner wall side) of the guard electrode 5 by movement of the supporting part 4.

When the edge region 52 is formed on the guard electrode 5, the edge region 52 covers and protects the circumferential edge region 31*a* of the electron generating portion 31 in the contact state of the emitter 3 and the guard electrode 5. Further, the edge region 52 restricts movement of the emitter 3 toward the other end side in the end-to-end direction. This allows easy positioning of the emitter 3 with respect to the discharge position (or the guard electrode 5).

In the illustrated embodiment, the guard electrode 5 is shaped to stepwisely decrease in diameter from one end side to the other end side such that a stepped region 53 is formed on the inner side of the guard electrode 5. By fixing the other end side of the bellows 43 to the stepped region 53, it is possible to easily fix the bellows 43 onto the guard electrode with a stable fixing structure. Furthermore, the electron generating portion 31 of the emitter 3 is moved on the inner side of the guard electrode 5 by being guided toward the small-diameter region 51 or the edge region 52 by the above-mentioned stepwise diameter decreasing shape.

When the bellows 43 is arranged inside the guard electrode 5 as illustrated in the figures, impact is prevented from being applied to the bellows 43 from the outer circumferential side of the vacuum vessel 11 (i.e. the bellows 43 is protected from damage and the like). Moreover, the arrangement of the bellows 43 inside the electrode 5 makes a contribution to downsizing of the X-ray apparatus 10. In the illustrated embodiment, a getter 54 is attached by welding to the outer circumferential side of the guard electrode 5. There are no particular limitations on the attachment position and material of the getter 54.

The circumferential edge region 31*a* of the electron generating portion 31 may be formed with a large apparent radius of curvature so as to suppress local field concentration at the electron generating portion 31 (in particular, the circumferential edge region 31*a*) and to suppress flashover from the electron generating portion 31 to the other portion. For example, it is feasible to form a convex curved surface region 51*a* on the other end side of the guard electrode 5 in the end-to-end direction as illustrated in the figures.

The target unit 70 includes: a target 7 opposed to and facing the electron generating portion 31 of the emitter 3; and a flange portion 70*a* supported on an end face 22*a* of the open end 22 of the insulator 2.

Various forms are applicable to the target 7 as long as the target 7 is adapted to radiate an X-ray L2 upon collision of the electron beam L1 from the electron generating portion 31 of the emitter 3. In the illustrated embodiment, the target 7 has an inclined surface 71 formed at a position opposed to the electron generating portion 31 of the emitter and extending in a direction intersecting and inclined at a predetermined angle with respect to the electron beam L1. By collision of the electron beam L1 with the inclined surface 71, the X-ray L2 is radiated in a direction bent from the emission direction of the electron beam L1 (e.g. in the transverse direction of the vacuum chamber 1)

Various forms are applicable to the grid electrode 8 as long as the grid electrode 8 is arranged between the emitter 3 and the target 7 and adapted to appropriately control the passage of the electron beam L1 therethrough. In the illustrated embodiment, for example, the grid electrode 8 includes: an electrode body 81 (e.g. mesh-like electrode body) extending in the transverse direction of the vacuum chamber 1 and having an passage hole 81*a* through which the electron beam L1 passes; and a lead terminal 82 piercing through the insulator 2 (in the transverse direction of the vacuum chamber 1).

In the above-structured X-ray apparatus 10, the distance between the electron generating portion 31 of the emitter 3 and the target 7 is changed by appropriate operation of the supporting part 4. In a state where field emission is suppressed upon movement of the electron generating portion 31 from the discharge position to the non-discharge position as shown in FIG. 2, it is possible to perform reforming treatment on the guard electrode 5, the target 7, the grid electrode 8 etc. as desired. This apparatus can be easily downsized and can be reduced in manufacturing labor and cost as compared to the above-mentioned conventional device with the large-diameter evacuation pipe.

≪ Reforming Treatment on Guard Electrode Etc. of X-Ray Apparatus 10≫

To perform reforming treatment on the guard electrode 5 of the X-ray apparatus 10, the emitter 3 is first moved toward the open end 21 side (to the non-discharge position) by operation of the supporting part 4 as shown in FIG. 2. Then, the apparatus is placed in a state where field emission from the electron generating portion 31 is suppressed, and more specifically, in a state where the electron generating portion 31 of the emitter 3 and the edge region 52 (in FIG. 3, the small-diameter region 51) of the guard electrode 5 are separated apart from each other (the emitter 3 is set to the non-discharge position (set lower than or equal to a discharge field). In this state shown in FIG. 2, the reforming treatment is performed on the guard electrode 5 (e.g. the surface of the guard electrode 5 is melted and smoothened) by appropriately applying a desired voltage between the guard electrode 5 and the grid electrode 8 (lead terminal 82) and repeatedly effecting discharge on the guard electrode 5.

After the above reforming treatment, the emitter 3 is moved toward the open end 22 side (to the discharge position) by again operating the supporting part 4 as shown in FIG. 1. The apparatus is then placed in a state where field emission from the electron generating portion 31 is allowed and, more specifically, in a state where the electron generating portion 31 of the emitter 3 and the edge region 52 of the guard electrode 5 are brought into contact with each other as shown in FIG. 1 (under vacuum pressure in the vacuum chamber 1). In this state shown in FIG. 1, electrons are generated from the electron generating portion 31 of the emitter 3 and emitted as the electron beam L1 by setting the electron generating portion 31 of the emitter 3 and the guard electrode 5 to the same potential and applying a desired voltage between the emitter 3 and the target 7. Upon collision of the electron beam L1 with the target 7, the X-ray L2 is radiated from the target 7.

It is possible by the above reforming treatment to suppress a flashover (electron generation) phenomenon from the guard electrode 5 in the X-ray apparatus 10 and stabilize the electron generation amount of the X-ray apparatus 10. It is also possible to emit the electron beam L1 in the form of a focused electron beam so that the X-ray L2 can be easily focused to achieve a high radioscopic resolution.

≪ Field Emission Device According to Embodiment 2≫

Figure 4:
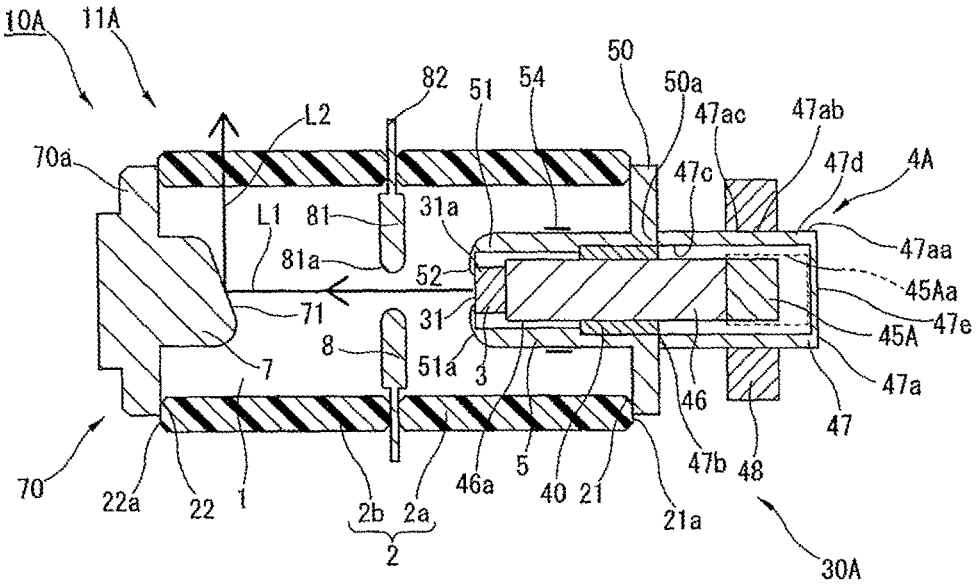
FIG. 4 is a schematic cross-section view of a field emission device according to Embodiment 2 of the present invention (taken along an end-to-end direction of a vacuum chamber 1 (in a state where an emitter 3 and a guard electrode 5 are in contact with each other)).
Figure 5:
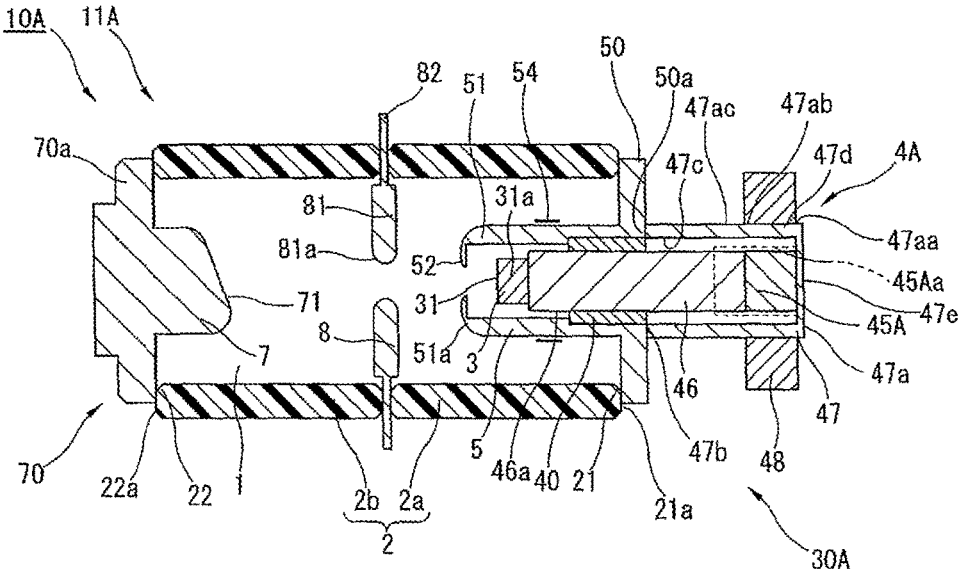
FIG. 5 is a schematic cross-sectional view of the field emission device according to Embodiment 2 of the present invention (taken along the end-to-end direction of the vacuum chamber 1 (in a state where the emitter 3 and the guard electrode 5 are separated apart from each other)).

Although the supporting part 4 is provided with the bellows 43 etc. in the X-ray apparatus 10 of FIGS. 1 and 2, it is alternatively feasible in the present aspect to provide an X-ray apparatus 10A with a supporting part 4A of the type using a magnetic attractive force as shown in FIGS. 4 and 5. This X-ray apparatus 10A can also obtain the same effects as those of the X-ray apparatus 10. It is herein noted that, in FIGS. 4 and 5, the same reference numerals are used to refer to the same parts and portions as those in FIGS. 1 to 3 and omit detailed explanations thereof.

In the X-ray apparatus 10A, one open end 21 of an insulator 2 is sealed by an emitter unit 30A to constitute a vacuum vessel 11A with a vacuum chamber 1 as shown in FIGS. 4 and 5. The emitter unit 30A includes: an emitter 3 having an electron generating portion 31 opposed to and facing a target unit 70 (target 7); a supporting part 4A that supports the emitter 3 movably in an end-to-end direction of the vacuum chamber; and a guard electrode 5 disposed on an outer circumferential side of the electron generating portion 31 of the emitter 3.

The supporting part 4A has a cylindrical column shape extending in the end-to-end direction on an inner side of the guard electrode 5 (i.e. a shape extending from a side of the emitter 3 opposite the electron generating portion 31), and includes: a magnetic body 45A located on one end side (open end 21 side; extending direction side) thereof; a supporting body 46 located on the other end side (open end 22 side) thereof to support the emitter 3; a circumferential wall 47 surrounding a movement range 45Aa in which the magnetic body 45A moves with movement of the supporting body 46; and a magnet 48 disposed on an outer wall surface 47*a* of the circumferential wall 47 (e.g. at a position opposed to the magnetic body 45A with the circumferential wall 47 sandwiched between the magnet 48 and the magnetic body 45A as illustrated in the figures).

A guide member 40 is formed with a smaller diameter than that of the guard electrode 5 and arranged between the supporting body 46 and the guard electrode 5 so as to extend coaxially in the end-to-end direction while allowing the supporting body 46 to pass therethrough. The supporting body 46 is thus slidably supported at an outer circumferential surface 46*a* thereof on the guide member 40 such that the supporting body 46 can be moved by being guided in the end-to-end direction by the guide member 40. Various materials are usable as the materials of the supporting body 46 and the guide member 40 without particular limitations. For example, the supporting body 46 can be made of a nonmagnetic material (e.g. metal material such as stainless steel (SUS) or copper); and the guide member 40 can be made of a molybdenum material or ceramic material.

Various forms are applicable to the magnetic body 45A as long as the magnetic body 45A and the magnet 48 are magnetically attractable to each other by the action of a magnetic force of the magnet 48 on the magnetic body 45A. There are no particular limitations on the material and shape of the magnetic body 45A. By way of example, the magnetic body 45A can be made of a magnetic material such as iron or SUS. In FIGS. 4 and 5, the magnetic body 45A has a cylindrical column shape substantially equal in diameter to the one end side of the supporting body 46.

Various forms are applicable to the circumferential wall 47 as long as the circumferential wall 47 is adapted to surround the movement range 45Aa without interfering with the movement of the supporting body 46, the movement of the magnetic body 45A and the magnetic force of the magnet 48 on the magnetic body 45A. In FIGS. 4 and 5, the circumferential wall 47 has a bottomed cylindrical shape extending from a portion of the vacuum vessel 11A opposed to the extending direction side of the supporting body 46 (i.e. opposed to the magnetic body 45A) outwardly of the vacuum vessel 11A. More specifically, the circumferential wall 47 has a bottomed cylindrical shape substantially equal in diameter to the guard electrode 5 such that an open end 47*b* of the bottomed cylindrical circumferential wall is sealed to the side of an opening 50*a* of a flange portion 50 of the guard electrode 5 (the vacuum chamber 1 is kept hermetically sealed) in FIGS. 4 and 5.

Various forms are also applicable to the magnet 48 as long as the magnet 48 is adapted to exert its magnetic force on the magnetic body 45A, which is situated on an inner circumferential surface 47*c* of the circumferential wall 47, to generate a magnetic attractive force between the magnet 48 and the magnetic body 45A and, at the same time, is attachable to and detachable from the outer wall surface 47*a* of the circumferential wall (i.e. slidable in the end-to-end direction on the outer wall surface 47*a*) under the magnetic attractive force. The magnet 48 can be formed of various metal and alloy materials as e.g. a permanent magnet so as to exert a desired magnetic force. The number of magnets 48 provided on the outer wall surface 47*a* is not particularly limited. In the case where a plurality of magnets 48 are provided (e.g. as split permanent magnets), the magnets 48 are spaced at given intervals along a circumferential direction of the circumferential wall 47.

In the X-ray apparatus 10A, the magnetic body 45A, the circumferential wall 47 and the magnet 48 are preferably set to satisfy the following relationship $t1 \leq t \leq t2$ (hereinafter occasionally just referred to as "relationship T"). In the relationship T of the X-ray apparatus 10A, t1 is defined as a distance from the movement range 45Aa of the magnetic body 45A to the outer wall surface 47*a* of the circumferential wall 47 at a position opposed to the movement range 45Aa; t2 is defined as a maximum distance at which the magnetic attractive force can be generated between the magnetic body 45A and the magnet 48 by the action of the magnetic force of the magnet 48; and t is defined as a minimum distance between the magnet 48 and the magnetic body 45A. It is feasible to satisfy the relationship T by, for example, determining the magnetic attractive force based on the corresponding magnetic area of the magnetic body 45A and the strength of the magnetic force of the magnet 48 and setting the thickness dimension of the circumferential wall 47 etc. according to the determined magnetic attractive force.

When the relationship T is satisfied in the X-ray apparatus 10A, the magnet 48 is attachable to and detachable from the outer wall surface 47*a* under the magnetic attractive force and is slidable along the outer wall surface 47*a* (in the end-to-end direction). By sliding movement of the magnet 48, a load in the sliding movement direction (i.e. the end-to-end direction) is imparted to the magnetic body 45A whereby the supporting body 46 is moved (by being guided by the guide member 40).

To facilitate the sliding movement of the magnet 48 along the outer wall surface 27*a*, it is conceivable to smoothen the outer wall surface 47*a*.

≪ Reforming Treatment on Guard Electrode Etc. of X-Ray Apparatus 10A≫

To perform reforming treatment on the guard electrode 5 of the X-ray apparatus 10A, the supporting part 4A is first operated as follows. As shown in FIG. 5, the emitter 3 is moved toward the open end 21 side (to the non-discharge position) by placing the magnet 48 on the outer wall surface 47*a* of a side portion 47*d* of the circumferential wall 47 at a position near a bottom 47*e* (e.g. manually sliding the magnet as appropriate to a non-discharge position surface area 47*aa*) and thereby moving the magnetic body 45A and the supporting body 46 toward the bottom 47*e* side. By this operation, the electron generating portion 31 of the emitter 3 and the edge region 52 (in FIGS. 4 and 5, the small-diameter region 51) of the guard electrode 5 are separated apart from each other (the emitter 3 is set to the non-discharge position (set lower than or equal to a discharge field)). Namely, the apparatus is placed in a state where field emission from the electron generating portion 31 is suppressed. In this state shown in FIG. 5, the reforming treatment is performed on the guard electrode 5 (e.g. the surface of the guard electrode 5 is melted and smoothened) by appropriately applying a desired voltage between the guard electrode 5 and the grid electrode 8 (lead terminal 82) and repeatedly effecting discharge on the guard electrode 5.

After the above reforming treatment, the emitter 3 is moved toward the open end 22 side (to the discharge position) by sliding the magnet 48 along the outer wall surface 47*a* of the side portion 47*d* from the bottom 47*e* side to the open end 47*b* side (e.g. sliding the magnet to a discharge position surface area 47*ac* over a neutral position surface area 47*ab*) as shown in FIG. 4 and thereby moving the magnetic body 45A and the supporting body 46 toward the open end 47*b* side (to the position opposed to the magnet 48 with the circumferential wall 47 sandwiched between the magnet 48 and the magnetic body 45A). By this operation, the electron generating portion 31 of the emitter 3 and the edge region 52 of the guard electrode 5 are brought into contact with each other. Namely, the apparatus is placed in a state where field emission from the electron generating portion 31 is allowed.

In this state shown in FIG. 4, electrons are generated from the electron generating portion 31 of the emitter 3 and emitted as an electron beam L1 by setting the electron generating portion 31 of the emitter 3 and the guard electrode 5 to the same potential and applying a desired voltage between the emitter 3 and the target 7. Upon collision of the electron beam L1 with the target 7, an X-ray L2 is radiated from the target 7.

It is possible by the above reforming treatment to suppress a flashover (electron generation) phenomenon from the guard electrode 5 in the X-ray apparatus 10A and stabilize the electron generation amount of the X-ray apparatus 10A. It is also possible to emit the electron beam L1 in the form of a focused electron beam so that the X-ray L2 can be easily focused to achieve a high radioscopic resolution.

≪ Field Emission Device According to Embodiment 3≫

Figure 6:
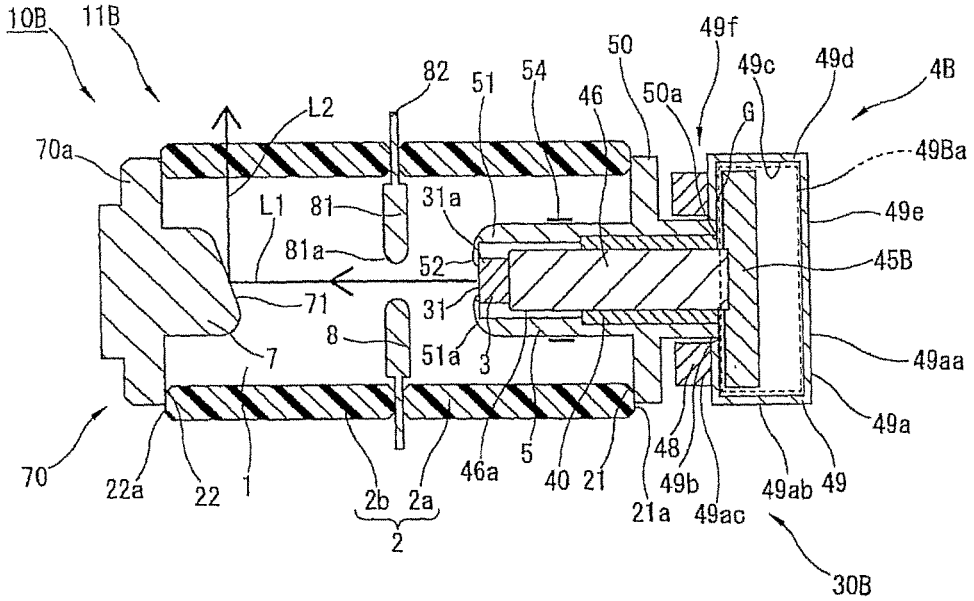
FIG. 6 is a schematic cross-section view of a field emission device according to Embodiment 3 of the present invention (taken along an end-to-end direction of a vacuum chamber 1 (in a state where an emitter 3 and a guard electrode 5 are in contact with each other)).
Figure 7:
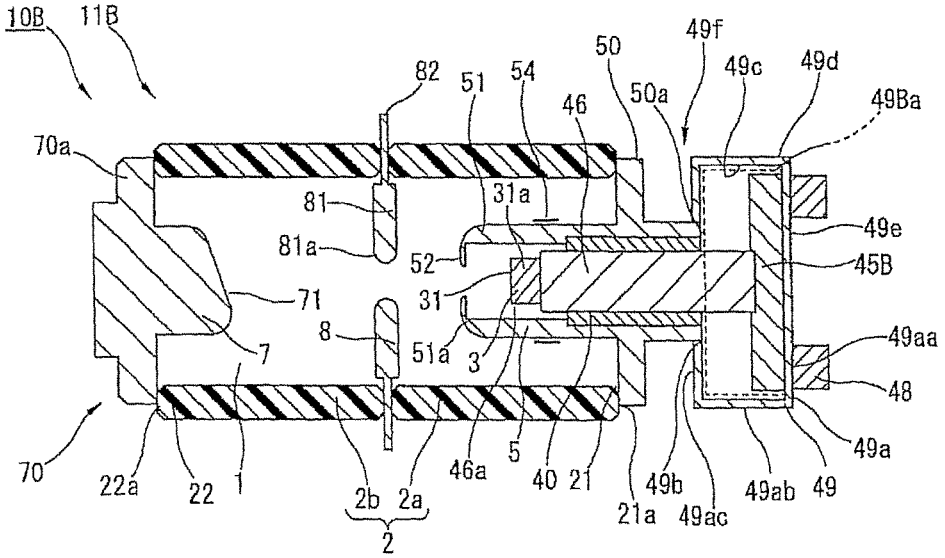
FIG. 7 is a schematic cross-sectional view of the field emission device according to Embodiment 3 of the present invention (taken along the end-to-end direction of the vacuum chamber 1 (in a state where the emitter 3 and the guard electrode 5 are separated apart from each other)).

It is feasible in the present aspect to provide an X-ray apparatus 10B with a supporting part 4B of the type using a magnetic body 45B with a large corresponding magnetic area as shown in FIGS. 6 and 7. This X-ray apparatus 10B can also obtain the same effects as those of the X-ray apparatuses 10 and 10A. It is herein noted that, in FIGS. 6 and 7, the same reference numerals are used to refer to the same parts and portions as those in FIGS. 1 to 5 and omit detailed explanations thereof.

In the X-ray apparatus 10B, one open end 21 of an insulator 2 is sealed by an emitter unit 30B to constitute a vacuum vessel 11B with a vacuum chamber 1 as shown in FIGS. 6 and 7. The emitter unit 30B includes: an emitter 3 having an electron generating portion 31 opposed to and facing a target unit 70 (target 7); a supporting part 4B that supports the emitter 3 movably in an end-to-end direction of the vacuum chamber; and a guard electrode 5 disposed on an outer circumferential side of the electron generating portion 31 of the emitter 3.

The supporting part 4B generally includes: a supporting body 46; a magnetic body 45B located on one end side (open end 21 side; extending direction side) of the supporting body 46 and made lager in diameter than the one end side of the supporting body 46 (in FIGS. 6 and 7, larger in diameter than an opening 50*a* of the guard electrode 50); a circumferential wall 49 surrounding a movement range 45Ba in which the magnetic body 45B moves along with the supporting body 46; and a magnet 48 disposed on an outer wall surface 49*a* of the circumferential wall 49 at a position opposed to the magnetic body 45B with the circumferential wall 49 sandwiched between the magnet 48 and the magnetic body 45B.

As in the case of the magnetic body 45A, various forms are applicable to the magnetic body 45B as long as the magnetic body 45B and the magnet 48 are magnetically attractable to each other by the action of a magnetic force of the magnet 48 on the magnetic body 45B. In FIGS. 6 and 7, the magnetic body 45B has a diameter larger than that of the one end side of the supporting body 46 and shows a large corresponding magnetic area easy to receive the magnetic force of the magnet 48.

Various forms are applicable to the circumferential wall 49 as long as the circumferential wall 49 is adapted to surround the movement range 45Ba without interfering with the movement of the supporting body 46, the movement of the magnetic body 45B and the magnetic force of the magnet 48 on the magnetic body 45B. As in the case of the circumferential wall 47, the circumferential wall 49 has a bottomed cylindrical shape extending from a portion of the vacuum vessel 11B opposed to the extending direction side of the supporting body 46 (i.e. opposed to the magnetic body 45B) outwardly of the vacuum vessel 11B, such that an open end 49*b* of the bottomed cylindrical circumferential wall is sealed to the side of an opening 50*a* of a flange portion 50 of the guard electrode 5 (the vacuum chamber 1 is kept hermetically sealed) in FIGS. 6 and 7.

A side portion 49*d* of the circumferential wall 49 is made larger in diameter than the magnetic body 45B, whereas an open end 49*b* side of the circumferential wall 49 is made smaller in diameter than the magnetic body 45B. There is thus formed a narrowed region (in FIGS. 6 and 7, an annular narrowed region) 49*f* having a smaller diameter than that of the magnetic body 45B, at a position between the movement range 45Ba of the magnetic body 45B and the emitter 3 on the vacuum vessel 11B. The magnetic 48 is arranged on the outer wall surface 49*a* of the narrowed region 49*f*.

As in the case of the X-ray apparatus 10A, the magnetic body 45B, the circumferential wall 49 and the magnet 48 of the X-ray apparatus 10B are preferably set to satisfy the relationship T. In the relationship T of the X-ray apparatus 10B, t1 is defined as a distance from the movement range 45Ba of the magnetic body 45B to the outer wall surface 49*a* of the circumferential wall 49 a position opposed to the movement range 45Ba; t2 is defined as a maximum distance at which the magnetic attractive force can be generated between the magnetic body 45B and the magnet 48 by the action of the magnetic force of the magnet 48; and t is defined as a minimum distance between the magnet 48 and the magnetic body 45B.

When the relationship T is satisfied in the X-ray apparatus 10B, the magnet 48 is attachable to and detachable from the outer wall surface 49*a* under the magnetic attractive force and is slidable along the outer wall surface 49*a*. By sliding movement of the magnet 48, a load in the sliding movement direction (i.e. the end-to-end direction) is imparted to the magnetic body 45B whereby the supporting body 46 is moved (by being guided by a guide member 40).

As in the case of the outer wall surface 47*a*, the outer wall surface 49*a* may be smoothened to facilitate the sliding movement of the magnet 48 along the outer wall surface 29*a*. Furthermore, there may be a gap G left between an inner wall surface 49*c* of the narrowed region 49*f* and the movement range 45Ba of the magnetic body 45B so as to suppress vacuum adhesion (i.e. adhesion of metal pipes under vacuum) therebetween.

≪ Reforming Treatment on Guard Electrode Etc. of X-Ray Apparatus 10B≫

To perform reforming treatment on the guard electrode 5 of the X-ray apparatus 10B, the supporting part 4B is first operated as follows. As shown in FIG. 7, the emitter 3 is moved toward the open end 21 side (to the non-discharge position) by placing the magnet 48 on the outer wall surface 49*a* of a bottom 49*e* of the circumferential wall 49 (e.g. manually sliding the magnet as appropriate to a non-discharge position surface area 49*aa*) and thereby moving the magnetic body 45B and the supporting body 46 toward the bottom 49*e* side. By this operation, the electron generating portion 31 of the emitter 3 and the edge region 52 (in FIGS. 6 and 7, the small-diameter region 51) of the guard electrode 5 are separated apart from each other (the emitter 3 is set to the non-discharge position (set lower than or equal to a discharge field)). Namely, the apparatus is placed in a state where field emission from the electron generating portion 31 is suppressed. In this state shown in FIG. 7, the reforming treatment is performed on the guard electrode 5 (e.g. the surface of the guard electrode 5 is melted and smoothened) by appropriately applying a desired voltage between the guard electrode 5 and the grid electrode 8 (lead terminal 82) and repeatedly effecting discharge on the guard electrode 5.

After the above reforming treatment, the emitter 3 is moved toward the open end 22 side (to the discharge position) by sliding the magnet 48 along the outer wall surface 49*a* from the bottom 49*e* side toward the narrowed region 49*f* (e.g. sliding the magnet to a discharge position surface area 49*ac* over a neutral position surface area 49*ab*) as shown in FIG. 6 and thereby moving the magnetic body 45B and the supporting body 46 toward the open end 49*b* side (to the position opposed to the magnet 48 with the circumferential wall 47 sandwiched between the magnet 48 and the magnetic body 45A).

By this operation, the electron generating portion 31 of the emitter 3 and the edge region 52 of the guard electrode 5 are brought into contact with each other as shown in FIG. 6. Namely, the apparatus is placed in a state where field emission from the electron generating portion 31 is allowed. As the magnet 48 is arranged on the outer wall surface 49*a* of the narrowed region 49*a* (in FIG. 6, the discharge position surface area 49*ac*) as shown in FIG. 6, the magnetic attractive force is exerted in the end-to-end direction so that it becomes easier to ensure the contact force between the electron generating portion 31 of the emitter 3 and the edge region 52 of the guard electrode 5 than in the X-ray apparatus 10A.

In this state shown in FIG. 6, electrons are generated from the electron generating portion 31 of the emitter 3 and emitted as an electron beam L1 by setting the electron generating portion 31 of the emitter 3 and the guard electrode 5 to the same potential and applying a desired voltage between the emitter 3 and the target 7. Upon collision of the electron beam L1 with the target 7, an X-ray L2 is radiated from the target 7.

It is possible by the above reforming treatment to suppress a flashover (electron generation) phenomenon from the guard electrode 5 in the X-ray apparatus 10B and stabilize the electron generation amount of the X-ray apparatus 10B. It is also possible to emit the electron beam L1 in the form of a focused electron beam so that the X-ray L2 can be easily focused to achieve a high radioscopic resolution.

Although the present invention has been described in detail with reference to the above specific embodiments, it is obvious to those skilled in the art that various modifications and variations of the embodiments described above are possible and fall within the scope of the present invention.

For example, the above embodiments specifically refer to the reforming treatment on the guard electrode 5. It is feasible to reforming treatment (surface melting and smoothening treatment) on the target 7 or the grid electrode 8 by applying a desired voltage in the state shown in FIG. 2, FIG. 5 or FIG. 7 and repeatedly effecting discharge on the target 7 or the grid electrode 8. Even in this case, the same effects can be obtained as in the reforming treatment on the guard electrode 5.

In the field emission device according to the present invention, the reforming treatment is performed on at least the guard electrode in the vacuum chamber by applying a voltage to the guard electrode in the state where the electron generating portion of the emitter and the guard electrode are separated apart from each other. Consequently, the field emission device according to the present invention attains a desired withstand voltage.

In the case where heat is generated upon collision of the electron beam with the target etc. in the field emission device, it is feasible to adopt a cooling system for cooling the field emission device. The cooling system is available in various forms such as air cooling system, water cooling system, oil cooling system and the like. In the case of oil cooling system, the field emission device may be immersed in a cooling oil inside a given container. In such an immersion state, the cooling oil may be degassed (e.g. with the use of a vacuum pump) as appropriate.

Although vacuum pressure in the vacuum chamber etc. is exerted on the supporting part, various configurations are applicable as long as the supporting part supports the emitter so as to allow movement of the emitter in the end-to-end direction of the vacuum chamber by operation of the supporting part.

For example, the supporting part may be configured to be moved in the end-to-end direction of the vacuum chamber by operation thereof and provide a moderation feeling (click feeling) at the time the emitter reaches a desired position e.g. discharge position or non-discharge position. This configuration makes various contributions and improvements, such as easy recognition of the position of the emitter during operation of the supporting part, improvement in the operability of the supporting part, and the like.

When the field emission device is provided with fixing mean to fix the emitter in the desired position as appropriate as mentioned above, the emitter is prevented from being displaced from the desired position even under the action of an unintended external force (in the case of adopting the aforementioned oil cooling function, e.g., a suction force exerted by the vacuum pump on the supporting part during the degassing of the cooling oil). This makes various contributions to achieve adequate field emission in the field emission device and adequate reforming treatment on the guard electrode etc. There is no particular limitation on the fixing means. The fixing means can be provided in various forms. In the above-mentioned X-ray apparatus 10, 10A, 10B, for example, it is feasible to adopt a stopper capable of locking by screw fastening etc. movement of the supporting portion 4 in the end-to-end direction or movement of the magnet 48 in the sliding direction.

The invention claimed is:

1. A field emission device, comprising:

a vacuum vessel with a cylindrical insulator, the insulator having both ends sealed to define a vacuum chamber on an inner wall side of the insulator;

an emitter located on one end side of the vacuum chamber and having an electron generating portion facing an other end side of the vacuum chamber;

a guard electrode disposed on an outer circumferential side of the electron generating portion of the emitter, the guard electrode having a cylindrical shape extending in an end-to-end direction of the vacuum chamber, one end side of the guard electrode being supported on and fixed to the vacuum vessel;

a target located on the other end side of the vacuum chamber and opposed to the electron generating portion of the emitter; and a supporting part that has a shape extending from a side of the emitter opposite the electron generating portion and supports the emitter movably in the end-to-end direction of the vacuum chamber, the supporting part being movable such that the emitter is moved in the end-to-end direction and thereby brought into contact with or separated apart from an other end side of the guard electrode by movement of the supporting part such that a distance between the electron generating portion of the emitter and the target is changed.

2. The field emission device according to claim 1, wherein the supporting part includes a bellows that is expandable and contractible in the end-to-end direction of the vacuum chamber and is supported at one end side thereof on the supporting part and at the other end side thereof on the vacuum vessel.

3. The field emission device according to claim 1, wherein the supporting part includes:

a supporting body that has a shape extending from a side of the emitter opposite the electron generating portion and supports the emitter movably in the end-to-end direction of the vacuum chamber;

a magnetic body disposed on an extending direction side of the supporting body;

a circumferential wall that has a shape extending outwardly from a portion of the vacuum vessel opposed to the extending direction side of the supporting body and surrounds a movement range in which the magnetic body moves with movement of the supporting body; and a magnet disposed on an outer wall surface of the circumferential wall; and wherein the relationship of $t1<t<t2$ is satisfied where $t1$ is a distance from the movement range of the magnetic body to the outer wall surface of the circumferential wall at a position opposed to the movement range of the magnetic body in a direction between the magnet and the movement range of the magnetic body;

$t2$ is a maximum distance at which a magnetic attractive force is generated between the magnet and the magnetic body by the action of a magnetic force of the magnet on the magnetic body; and $t$ is a minimum distance between the magnet and the magnetic body.

4. The field emission device according to claim 3, wherein the magnetic body has a diameter larger than that of the extending direction side of the supporting body; and wherein the circumferential wall includes a narrowed region formed between the movement range of the magnetic body and the emitter and having a diameter smaller than that of the magnetic body.

5. The field emission device according to claim 4,
wherein there is a gap left between an inner wall surface of the narrowed region and the movement range of the magnetic body.

6. The field emission device according to claim 1,
wherein the guard electrode has a cylindrical shape extending in the end-to-end direction of the vacuum chamber on the outer circumferential side of the emitter; and
wherein the electron generating portion of the emitter is moved by the movement of the supporting part such that the electron generating portion is brought into contact with or separated apart from a target side of the guard electrode.

7. The field emission device according to claim 6,
wherein the guard electrode has a small-diameter region formed on the target side thereof.

8. The field emission device according to claim 6,
wherein the guard electrode has an edge region formed on the target side thereof such that the edge region extends in a transverse direction of the vacuum chamber and overlaps a circumferential edge region of the electron generating portion of the emitter in the end-to-end direction of the vacuum chamber.

9. The field emission device according to claim 1, further comprising a grid electrode arranged between the emitter and the target within the vacuum chamber.

10. A reforming treatment method for the field emission device according to claim 1, comprising:
performing reforming treatment on at least the guard electrode within the vacuum chamber by the application of a voltage to the guard electrode in a state where the electron generating portion of the emitter and the guard electrode are separated apart from each other by operation of the supporting part.

11. A field emission device, comprising:
a vacuum vessel with a cylindrical insulator, the insulator having both ends sealed to define a vacuum chamber on an inner wall side of the insulator;
an emitter located on one end side of the vacuum chamber and having an electron generating portion facing an other end side of the vacuum chamber;
a target located on the other end side of the vacuum chamber and opposed to the electron generating portion of the emitter;
a guard electrode disposed on an outer circumferential side of the electron generating portion of the emitter, the guard electrode having a cylindrical shape extending in an end-to-end direction of the vacuum chamber, one end side of the guard electrode being supported on and fixed to the vacuum vessel;
a supporting body that has a shape extending from a side of the emitter opposite the electron generating portion and supports the emitter, the supporting body being movable such that the emitter is moved in the end-to-end direction and thereby brought into contact with or separated apart from an other end side of the guard electrode by movement of the supporting body; and
a bellows supported at one end side thereof on the supporting body and supported at the other end side thereof on the vacuum vessel thereby comprising a part of the vacuum vessel.

12. The field emission device according to claim 11,
wherein the guard electrode has a cylindrical shape extending in the end-to-end direction of the vacuum chamber on the outer circumferential side of the emitter; and
wherein the electron generating portion of the emitter is moved by the movement of the supporting body such that the electron generating portion is brought into contact with or separated apart from a target side of the guard electrode.

13. The field emission device according to claim 12,
wherein the guard electrode has a small-diameter region formed on the target side thereof.

14. The field emission device according to claim 12,
wherein the guard electrode has an edge region formed on the target side thereof such that the edge region extends in a transverse direction of the vacuum chamber and overlaps a circumferential edge region of the electron generating portion of the emitter in the end-to-end direction of the vacuum chamber.

15. The field emission device according to claim 11, further comprising a grid electrode arranged between the emitter and the target within the vacuum chamber.

16. A reforming treatment method for the field emission device according to claim 11, comprising:
performing reforming treatment on at least the guard electrode within the vacuum chamber by the application of a voltage to the guard electrode in a state where the electron generating portion of the emitter and the guard electrode are separated apart from each other by operation of the supporting body.

17. A field emission device, comprising:
a vacuum vessel with a cylindrical insulator, the insulator having both ends sealed to define a vacuum chamber on an inner wall side of the insulator;
an emitter located on one end side of the vacuum chamber and having an electron generating portion facing an other end side of the vacuum chamber;
a target located on the other end side of the vacuum chamber and opposed to the electron generating portion of the emitter;
a guard electrode disposed on an outer circumferential side of the electron generating portion of the emitter, the guard electrode having a cylindrical shape extending in an end-to-end direction of the vacuum chamber and being supported at one end side thereof on the vacuum vessel; and
a supporting part,
wherein the supporting part includes:
a supporting body that has a shape extending from a side of the emitter opposite the electron generating portion and supports the emitter;
a magnetic body disposed on an extending direction side of the supporting body;
a circumferential wall that has a shape extending outwardly from a portion of the vacuum vessel opposed to the extending direction side of the supporting body and surrounds the supporting body and the magnetic body; and
a magnet disposed on an outer wall surface of the circumferential wall; and
wherein the relationship of $t1 \leq t \leq t2$ is satisfied where
t1 is a distance from a movement range of the magnetic body to the outer wall surface of the circumferential wall at a position opposed to the movement range of the magnetic body in a direction between the magnet and the movement range of the magnetic body;
t2 is a maximum distance at which a magnetic attractive force is generated between the magnet and the magnetic body by the action of a magnetic force of the magnet on the magnetic body; and t is a minimum distance between the magnet and the magnetic body.

18. The field emission device according to claim 17, wherein the magnetic body has a diameter larger than that of the extending direction side of the supporting body; and wherein the circumferential wall includes a narrowed region formed between the movement range of the magnetic body and the emitter and having a diameter smaller than that of the magnetic body.

19. The field emission device according to claim 18, wherein there is a gap left between an inner wall surface of the narrowed region and the movement range of the magnetic body.

20. The field emission device according to claim 17, wherein the guard electrode has a cylindrical shape extending in the end-to-end direction of the vacuum chamber on the outer circumferential side of the emitter; and wherein the electron generating portion of the emitter is moved by the movement of the supporting part such that the electron generating portion is brought into contact with or separated apart from a target side of the guard electrode.

21. The field emission device according to claim 20, wherein the guard electrode has a small-diameter region formed on the target side thereof.

22. The field emission device according to claim 20, wherein the guard electrode has an edge region formed on the target side thereof such that the edge region extends in a transverse direction of the vacuum chamber and overlaps a circumferential edge region of the electron generating portion of the emitter in the end-to-end direction of the vacuum chamber.

23. The field emission device according to claim 17, further comprising a grid electrode arranged between the emitter and the target within the vacuum chamber.

24. A reforming treatment method for the field emission device according to claim 17, comprising:

performing reforming treatment on at least the guard electrode within the vacuum chamber by the application of a voltage to the guard electrode in a state where the electron generating portion of the emitter and the guard electrode are separated apart from each other by operation of the supporting part.

* * * * *